US007107707B2

(12) United States Patent
Schenone

(10) Patent No.: US 7,107,707 B2
(45) **Date of Patent: *Sep. 19, 2006**

(54) ARTICLE OF FOOTWEAR INCLUDING A THEMATICAL TOE COVER

(75) Inventor: David J. Schenone, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/137,780

(22) Filed: May 26, 2005

(65) Prior Publication Data

US 2005/0268495 A1 Dec. 8, 2005

Related U.S. Application Data

(63) Continuation of application No. 10/437,998, filed on May 15, 2003, now Pat. No. 6,898,873.

(51) Int. Cl.
*A43B 3/24* (2006.01)

(52) U.S. Cl. ..... 36/101; 36/100; 36/112; 36/136

(58) Field of Classification Search ..... 36/112, 36/136, 132, 101, 72 R; 446/26; D2/897, D2/899, 900, 976; D21/658–661, 578, 916
See application file for complete search history.

(56) References Cited

U.S. PATENT DOCUMENTS

| | | | |
|---|---|---|---|
| D78,569 | S | 5/1929 | Goldberg |
| 1,952,294 | A | 3/1934 | Strauss |
| 2,160,768 | A | 5/1939 | Wasser |
| 2,271,595 | A | 5/1942 | Langendorf |
| 2,392,867 | A | 1/1946 | Stoner et al. |
| 3,102,347 | A | 9/1963 | Griswold et al. |
| 3,175,311 | A | 3/1965 | MacQuaid |
| 3,473,198 | A | 10/1969 | Meier |
| 4,300,256 | A | 11/1981 | Laganas |
| 4,333,248 | A | 6/1982 | Samuels |
| 4,845,865 | A | 7/1989 | Chang et al. |
| 5,070,630 | A | 12/1991 | Edmundson |
| D365,859 | S | 1/1996 | Choi |

(Continued)

FOREIGN PATENT DOCUMENTS

| | | |
|---|---|---|
| FR | 2 246 163 | 9/1973 |

OTHER PUBLICATIONS

KopakaFan's bionicle Website, Special Pictures (15 pages); published prior to filing application.

*Primary Examiner*—Ted Kavanaugh
(74) *Attorney, Agent, or Firm*—Banner & Witcoff, Ltd.

(57) ABSTRACT

There is provided an article of footwear having a thematical a toe box cover. The toe box cover may be removably coupleable to a primary shoe element in which the toe box cover has an ornamental sculptured work simulating the appearance of another and different article. A covering system for an article of footwear, includes a themed cover adapted to cover at least a forefoot portion of a foot of a wearer. The themed cover may include a flange provided for removably coupling the themed cover to the article of footwear and the flange is disposed on bottom periphery of the themed cover. Further, a plurality of interchangeable footcovers bears different three-dimensional ornamental simulations within a common theme relating to another article of manufacture. There is also provided a method of marketing an article of manufacture with an article of footwear, in which the article of manufacture is different from the article of footwear.

14 Claims, 12 Drawing Sheets

U.S. PATENT DOCUMENTS

| | | | | |
|---|---|---|---|---|
| 5,878,511 | A | 3/1999 | Krajcir | |
| 5,926,978 | A | 7/1999 | Smith | |
| 5,946,823 | A | 9/1999 | Yates | |
| 5,979,085 | A | 11/1999 | Ross | |
| 6,475,051 | B1 | 11/2002 | Griffin et al. | |
| 6,546,649 | B1 | 4/2003 | Tobias | |
| 6,640,467 | B1 | 11/2003 | Krull | |
| 6,898,873 | B1 * | 5/2005 | Schenone | 36/112 |
| 2002/0194750 | A1 | 12/2002 | Feick | |

* cited by examiner

ARTICLE OF FOOTWEAR INCLUDING A THEMATICAL TOE COVER

CROSS-REFERENCE TO RELATED APPLICATIONS

This application is a continuation of the U.S. Patent Application No. 10/437,998 filed May 15, 2003 now U.S. Pat. No. 6,898,873, which is hereby incorporated by reference.

FIELD OF THE INVENTION

The present invention pertains to an article of footwear, especially for athletic footwear. More particularly, the invention relates to athletic footwear having a thematical toe cover.

BACKGROUND OF THE INVENTION

Applied graphics, such as printed designs, have been applied to the outside of shoe uppers to entice interest in footwear for children. The graphical application of a particular design may provide a temporarily appeal to children. However, drawbacks to these arrangements are inherent in the appearance of the designs themselves and in the nature of the permanence of the applied designs.

For instance, as a group, children have fast-changing tastes and desires than any other demographic group. Thus, parents may have experienced purchasing shoes for their children only to be dismayed that the child has changed their mind on their interests regarding the applied graphics and/or how the shoe looks before the shoes have been barely worn.

SUMMARY OF THE INVENTION

Briefly, the present invention is pertains to an article of footwear having a thematical toe cover arrangement.

In one aspect of the present invention, an article of footwear includes a toe box cover that is removably coupleable to a primary shoe element in which the toe box cover has an ornamental sculptured work simulating the appearance of another and different article. In this way, an article of footwear can be advantageously provided for predefined themes or subject areas to provide value for children in play activities or other purposes.

In another aspect of the present invention, a covering system for an article of footwear, includes a themed cover adapted to cover at least a forefoot portion of a foot of a wearer. The themed cover is removably coupleable to the article of footwear. In a further aspect, the themed cover includes a flange provided for removably coupling the themed cover to the article of footwear and the flange is disposed on a bottom periphery of the themed cover.

In yet another aspect of the present invention, a themed footwear system for an article of footwear is provided. A plurality of interchangeable footcovers bears different three-dimensional ornamental simulations within a common theme relating to another article of manufacture. The footcovers are configured to enclose a primary portion of the article of footwear. Advantageously, children can use the interchangeable toe box covers for role playing or playing games with their favorite toy.

In a further aspect, the present invention provides a method of marketing an article of manufacture with an article of footwear, the article of manufacture being different from the article of footwear. A primary footwear element is exposed for sale. A plurality of distinct toe box covers each removably coupleable to the primary footwear element is exposed along with the primary footwear element. Each of the toe box covers has an ornamental sculptural design simulating the appearance of another and different article. A user is permitted to choose at least one of the toe box covers; and the primary footwear element and the selected toe box cover is sold to the user.

In one aspect, the present invention provides footwear with a thematic cover member configured to swathe a forefoot portion of the upper in which the thematic cover member is an ornamental article for the upper. In one aspect, an interchangeable style or fashion implement. Advantageously, the consumer can change the appearance of a shoe several times within a day for different outfits, and no one would know that they had worn the same shoe the entire day or evening. Hence, the replaceable toe box covers provides efficiency to the consumer and reduces footwear costs. In a further advantage, marketing and promotional activities can be greatly enhanced with the toe box covers.

A system can be provided to or purchased by sports fans so that they can wear simulated equipment of their favorite team. In one aspect, footwear of the present invention provides a toe box cover configured to simulate a caricatured portion of a sports player, such as their head or facial features. In this manner, fans of the sports teams and players may wear toe covers having simulated features of their favorite players to greatly enhance the sporting fan's excitement at a game or other location or display the fan's team spirit.

The above, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
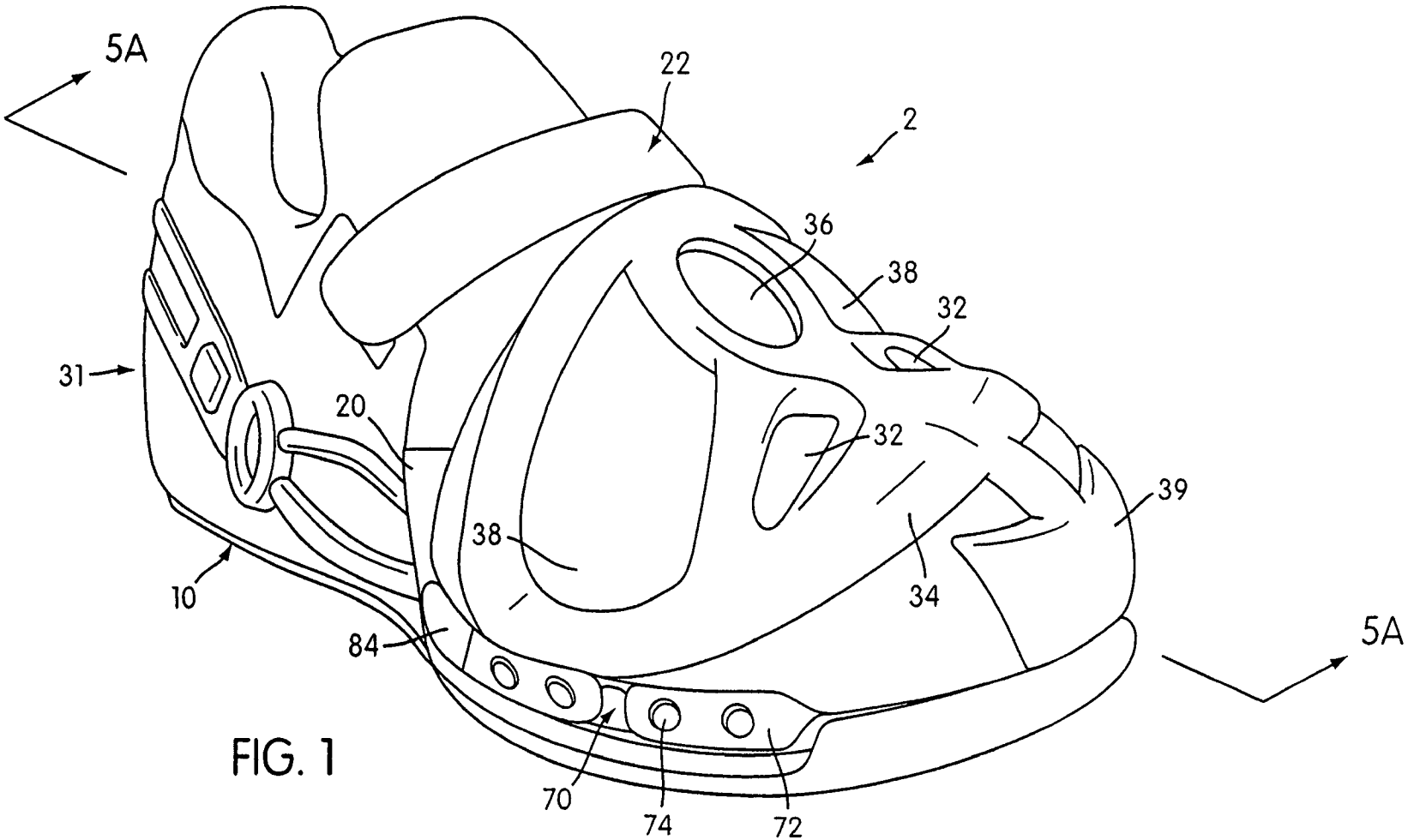
FIG. 1 is a perspective view of a first embodiment of article of footwear with a themed toe box cover according to a teaching of the present invention.

With reference to FIGS. 1–5B, an article of footwear system, for example an athletic shoe with a toe box covering, in accordance with the present invention is illustrated. The article of footwear is generally referred to herein as a shoe 2. Shoe 2 includes a sole 10, an upper 20. A thematic toe box cover 30 is removably attachable to the shoe 2 and is configured to cover at least the toe box portion and/or the forefoot portion of shoe 2. Further, shoe 2 has a medial side 16 and a lateral side 18. When the shoe 2 is worn the lateral side 18 generally faces away from the centerline of a user's body. Likewise, the medial side 16 generally faces inward towards the centerline of a user's body.

For ease of explanation, the terms forefoot portion, midfoot portion, and rearfoot portion or the respective regions as used herein generally correspond to the locations of the forefoot, midfoot, and rearfoot of a wearer as would be understood by one of ordinary skill in the art. The phrase "primary footwear portion" is defined herein as the article of footwear without an ornamental toe box cover.

Figure 5A:
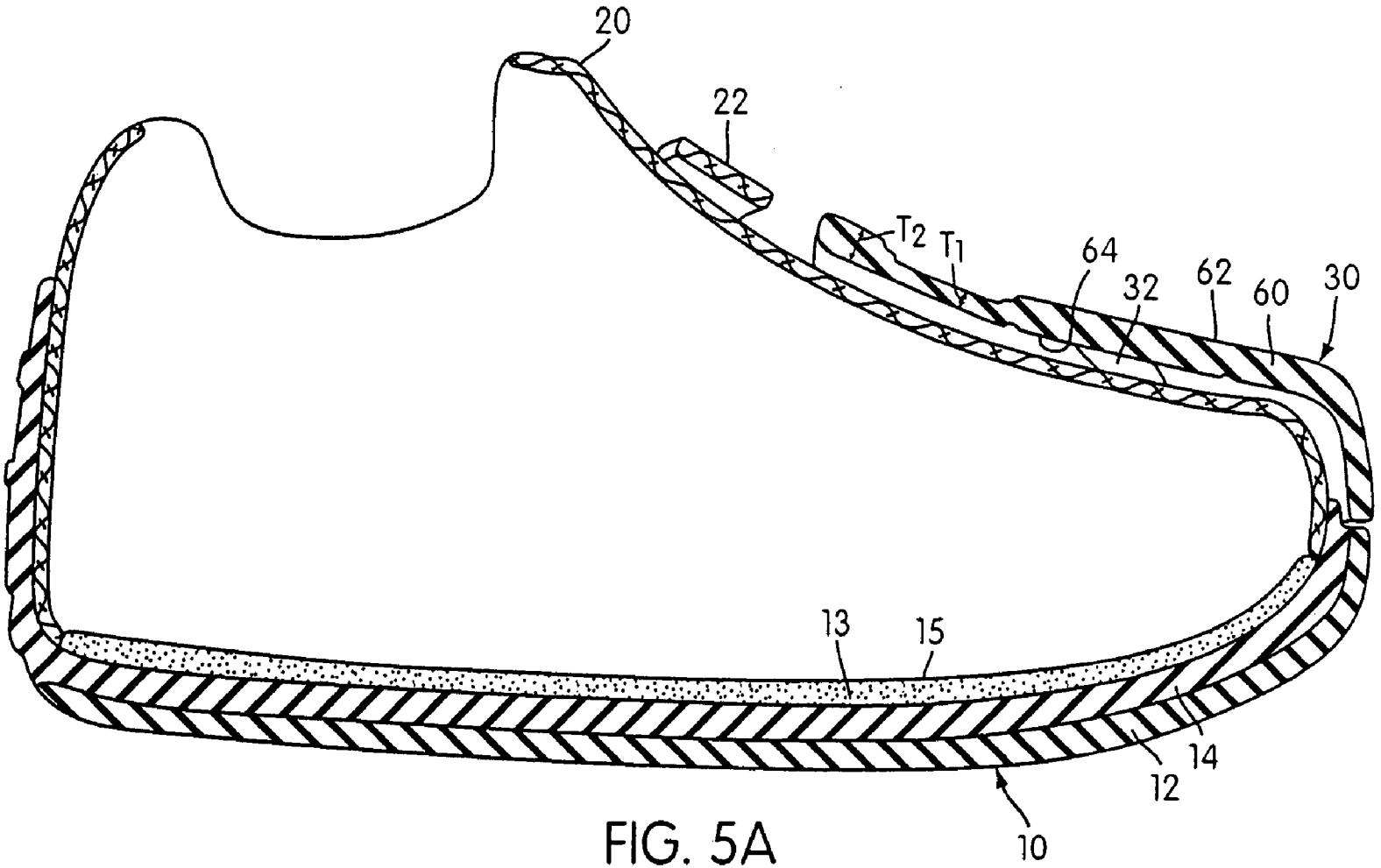
FIG. 5A is a cross section of the article of footwear with the themed toe box cover of FIG. 1 taken along line 5A—5A.

Upper 20 is fastened around its periphery to the sole 10 by any suitable method such as, stitching or adhesive bonding. Sole 10 may be composed of a single unitary element, or may be composed of separate components such as outsole 12 and a midsole 14 as is shown in FIG. 5A. The outsole 12 provides a lower ground engaging surface designed for traction control and typically made of a tough rubber material for wear resistance. The midsole 14 provides cushioning, support and has greater compressibility than outsole 12 to achieve its cushioning function. Any conventional sole construction may be used provided that it has sufficient support and traction for the foot of the wearer for the desired activity or sport to be performed.

The upper 10 also includes a desirable foot fastening system for securing the shoe 2 to the foot of the wearer. For example, referring to FIGS. 1–3, a foot fastening system 22 includes a tensioning strap 24 formed with an adjustability feature having a hook and loop system, similar to VELCRO® fastening system. Nevertheless, the foot fastening system 22 may have other arrangements, such as a lacing system, to hold the foot in the shoe 2. Upper 10 may also be made of a stretch material that inherently performs the function of a foot fastening system.

Referring to FIGS. 1–4, the upper 10 of the shoe 2 is, but need not be, constructed of a material or a combination of materials thereof such as, split-leather, full-grain leather, suede, polyester, nylon, or a breathable mesh. As shown in FIGS. 5A and 5B, the shoe 2 may include an insole or sockliner 13 disposed inside of the shoe 2 and is preferably positioned between the foot of the wearer and the sole 10. In addition, the sockliner 13 further includes an upper surface defining a footbed 15, that is, the portion of the shoe 2 that is in contact with the bottom of the foot of the wearer. The sockliner 13 provides additional cushioning and shock absorption of the shoe 2. If desired, the sockliner 13 may be removable and replaceable for the shoe 2. The sockliner 13 may be composed of polyester ethyl vinyl acetate (PEEVA) material. The upper surface or footbed 15 of sockliner 13 may be generally composed of a knit fabric mounted or bounded to the PEEVA material.

Figure 2:
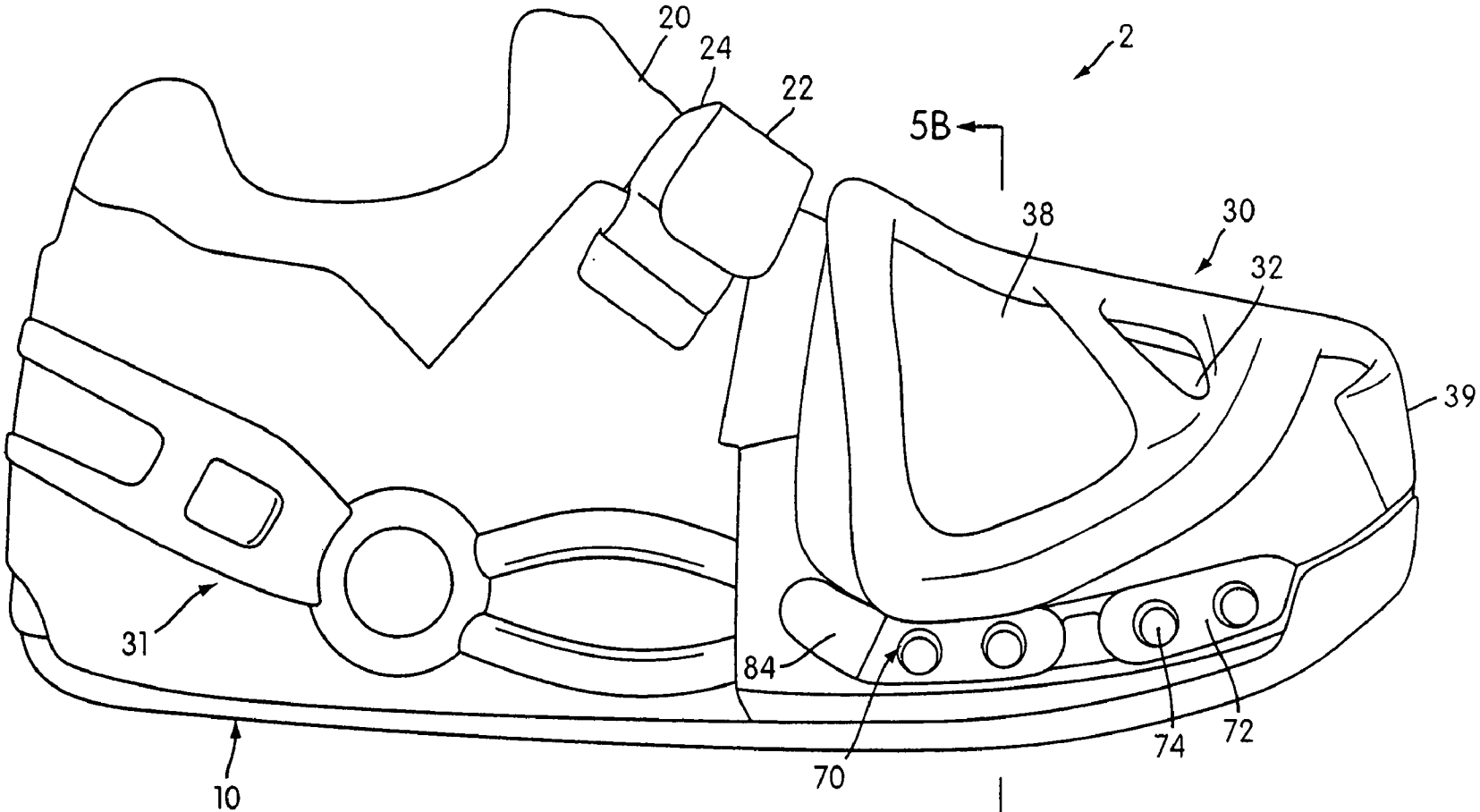
FIG. 2 is an elevational side view of the embodiment of the article of footwear with the themed toe box cover shown in FIG. 1.
Figure 3:
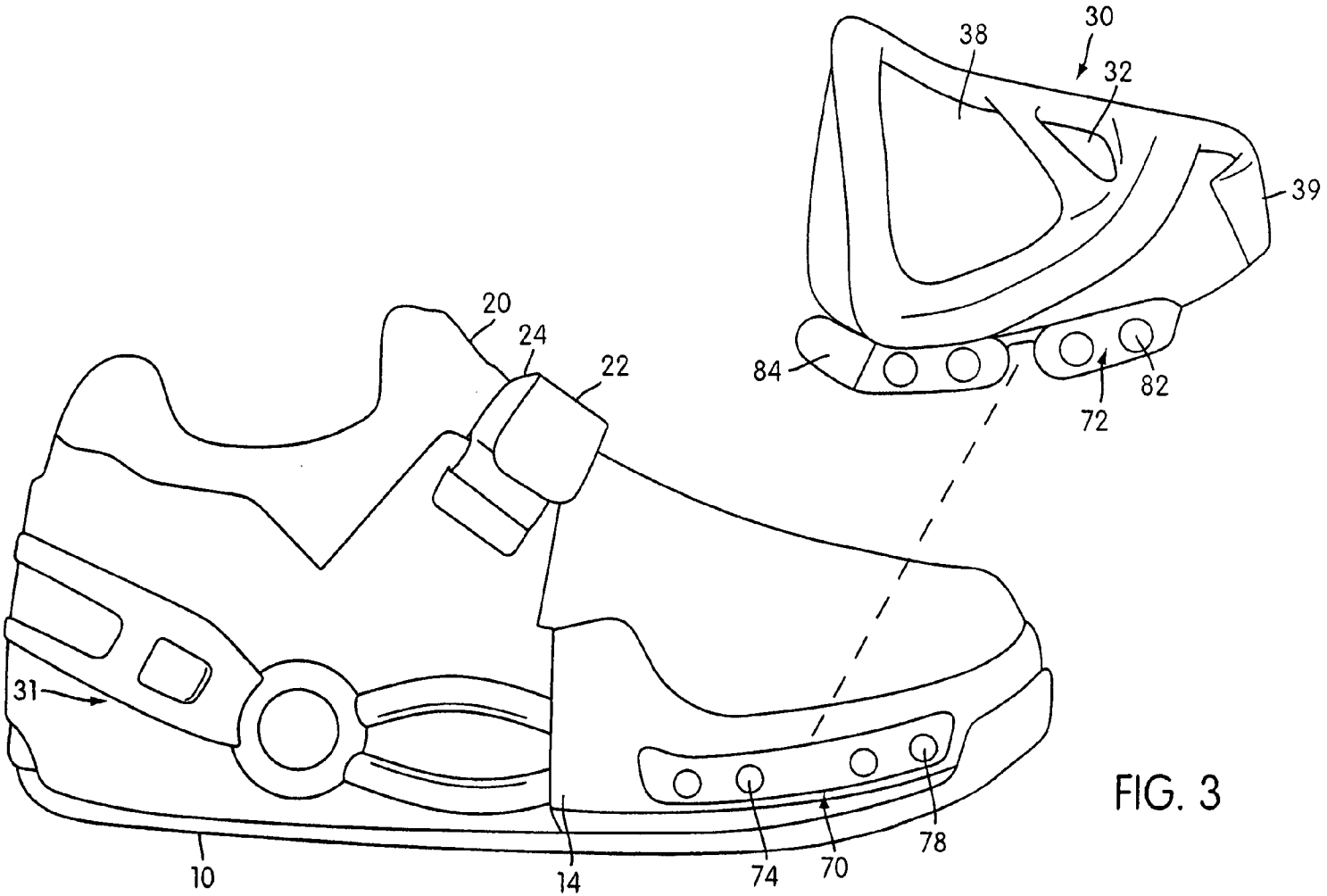
FIG. 3 is an exploded assembly view of the article of footwear of FIG. 1–2 with a themed toe box cover in an interchangeable arrangement.

Referring to FIGS. 1–3, thematic toe box cover 30 is configured to be coupled to and enclose a portion of the article of footwear. In accordance with the present invention, toe box cover 30 may be formed in a virtually any distinctive shape and variations to provide a desired thematic stylized representation of another article of manufacture or product.

Figure 6:
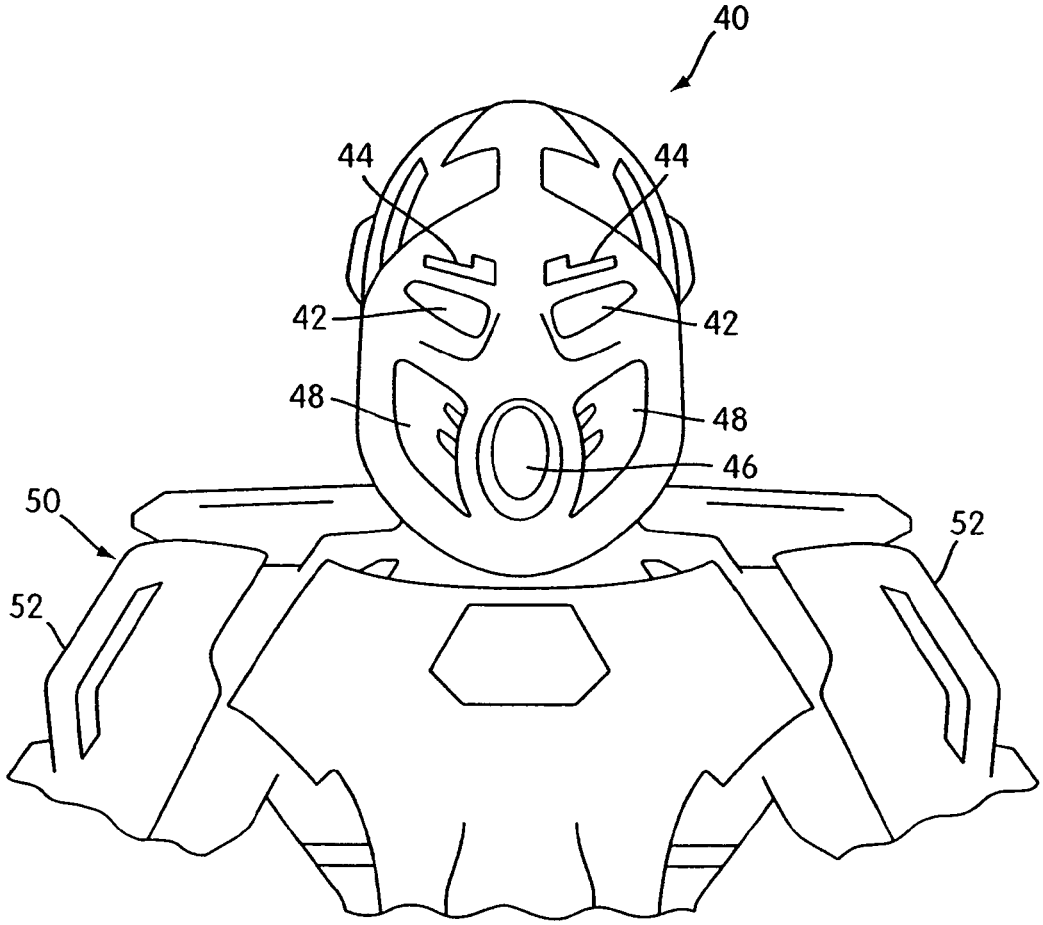
FIG. 6 is a front view of an existing robotic action figure.

In one embodiment, toe box cover 30 comprises a first ornamental footwear element formed as a unique ornamental sculpture work or molding. Referring to FIG. 6, in one example, an article of manufacture or product may be an article, such as an action figure toy robot 40. Action FIG. 40 has facial features that include visual appearance and structural features, such as eye openings 42, eyebrows 44, a nose 46, jaw portions 48, and a spike 49. In accordance with an embodiment, referring to FIG. 4, the toe box cover 30 simulates a face of the toy robot action FIG. 40. For example, the toy robot action figure may be an action figure from the BIONICLE™ line of toys marketed by the LEGO® Company.

To create the simulation, toe box cover 30 has an outer topography with sufficient physical shape variations in the contour and holes or apertures to create a sculptured three-dimensional appearance. Accordingly, as shown in FIGS. 1–4, toe box cover 30 includes molded features, such as eye openings 32, eyebrow portions 34, a nose portion 36, jaw portions 38, and spike portion 39 that are stylized representations of the corresponding features of toy robot action FIG. 40. In this manner, a shoe 2 and the simulated article different from the shoe, are used together to provide the ability to reach the consuming public for numerous purposes. For instance, children can use the shoe and toe box cover for play. The children can become excited about the stylized simulation and childhood boredom can be greatly reduced. Also, based on physical feature and attractive three-dimensional appearance of the toe box cover, it can be used as a way of enticing children to become interested in the shoe, which in turn will stimulate their creative ability and imagination.

In another embodiment, the shoe 2 may include additional ornamental footwear elements that pertain to a common or linking theme of the first ornamental footwear element. Accordingly, the medial side 16 and the lateral side 18 of shoe 2 each includes a second ornamental footwear element that has sculptured features which are thematically associated with the ornamental simulation formed by toe box cover 30. For example, in FIG. 6, toy robot action FIG. 40 has a torso portion 50 with two articulated limbs 52 similar to a robotic appearance. Accordingly, as shown in FIGS. 1–3, the exposed medial side 16 of shoe 2 in the midfoot and rearfoot regions includes a fixedly attached and/or inherently formed thematical panel 31 having a sculptured mechanical appearance that simulates in a stylized manner, the torso and limb appearance of the action figure, and complements the simulated robotic head formed by toe box cover 30.

Figure 9:
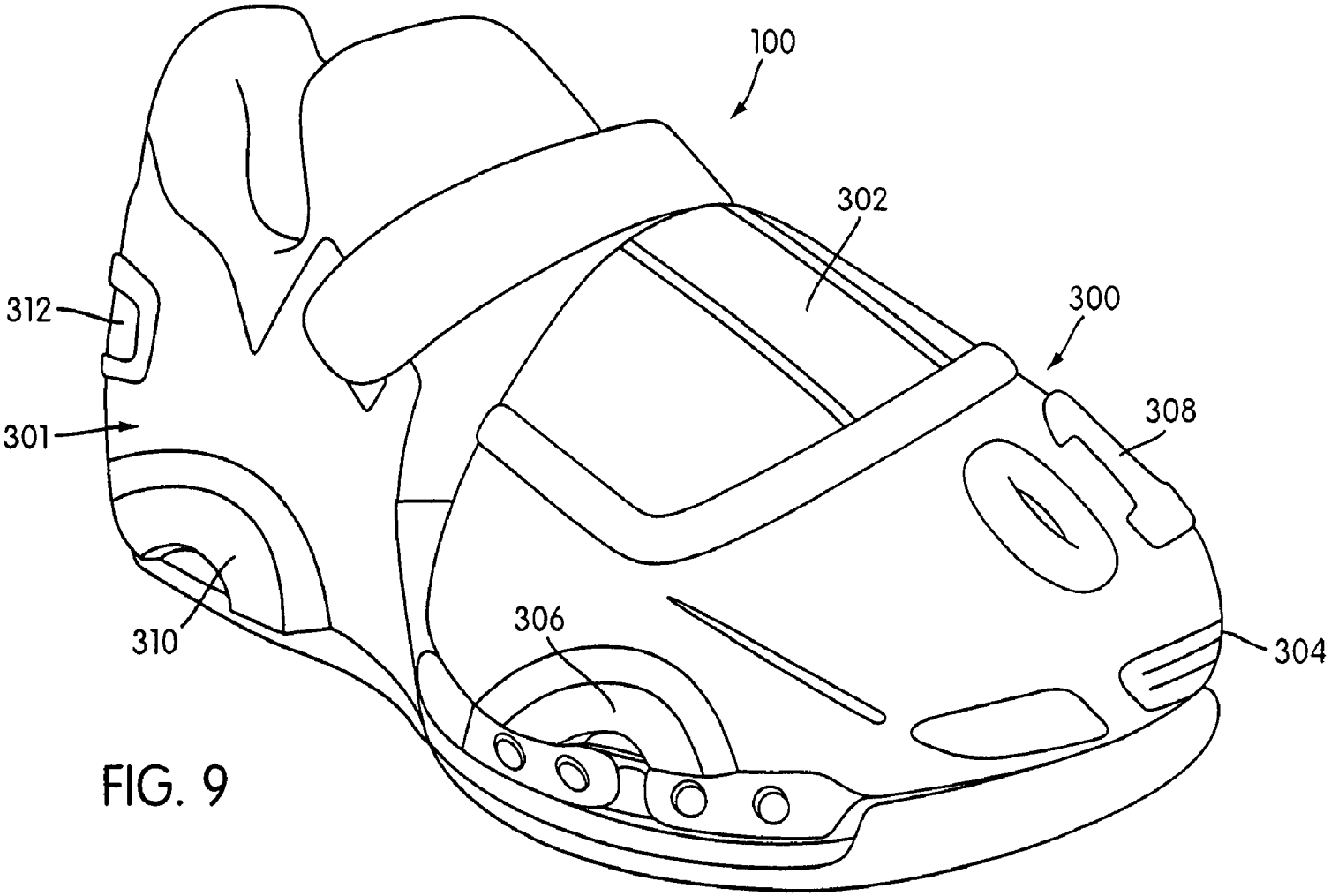
FIG. 9 is a perspective view of a third embodiment of an article of footwear with an alternative themed toe box cover according to a teaching of the present invention.

FIG. 9 shows a shoe 100 with a toe box cover 300 in an alternative embodiment. Accordingly, a shoe 100 including a toe box cover 300, provides a three-dimensional stylized appearance that simulates the three-dimensional appearance of a portion of a vehicle, such as a front outer body portion of a racing automobile. An automobile can be any number of variations and distinctive shapes, including fuel-based automobiles for NASCAR™ to consumer based automobiles. In the example shown in FIG. 6, toe box cover 300 is an ornamental molded article having distinctive automotive simulated features, such as a windshield portion 302, a front grill portion 304, wheel portions 306, and racing numbers 308. In a further aspect of the alternative arrangement, the medial and/or lateral side of shoe 100 includes molded visual appearance features that are thematically linked to the toe box cover 300. In particular, the midfoot region and rearfoot region on the medial side of shoe 100 have a thematical panel 301 that simulates the appearance of a racing automobile to complement the simulated automobile appearance of toe box cover 300. Accordingly, midfoot portion of shoe 100 includes a three-dimensional stylized wheeled portion 310 and rearfoot portion providing a simulated three-dimensional rear feature 312 of an automobile. Hence, shoe 100 has a first ornamental footwear element, e.g. toe box cover 300 and may include a second ornamental footwear element relating to the common theme of racing automobiles.

Figure 10:
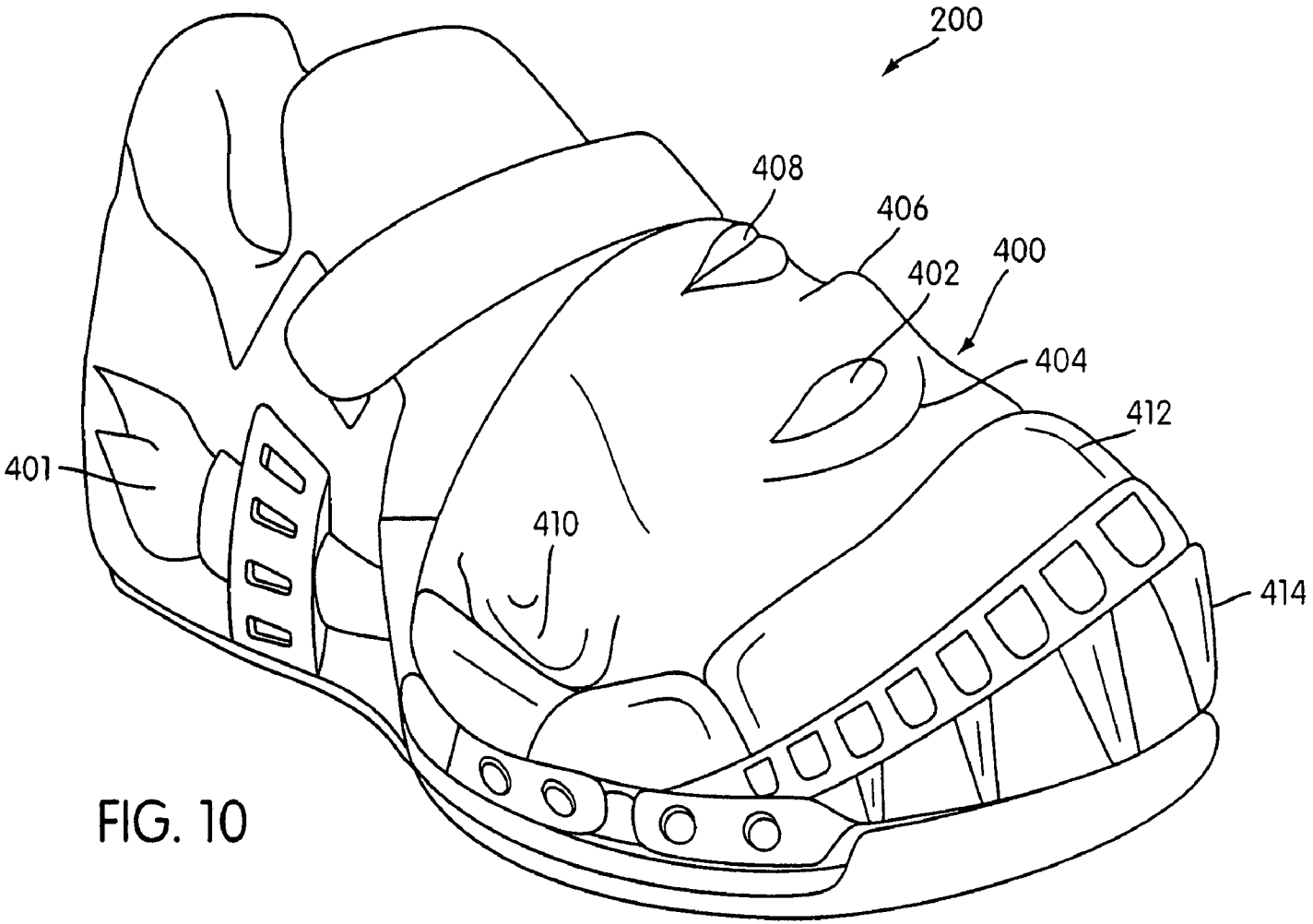
FIG. 10 is a perspective view of a fourth embodiment of article of footwear with another alternative themed toe box cover according to a teaching of the present invention.

Referring to FIG. 10, in yet another alternative arrangement, a shoe 200 includes a toe box cover 400 that simulates the appearance of a national landmark, national figure, or famous structure, such as the Statue of Liberty. The Statue of Liberty is a familiar and well-recognized national landmark in the harbor of New York City, N.Y. Thus, toe box cover 400 is an ornamental sculptural article which simulates the face and head portion of the Statue of Liberty. Toe box cover 400 has sculptured simulated features including eye portions 402 formed by holes, eyebrow portions 404, a nose portion 406, a mouth portion 408, ear portions 410, a hair portion 412, and a crown portion 414. In a further aspect of the alternative arrangement shown in FIG. 10, shoe 200 midfoot and rearfoot portions include visual appearance and structural features which are linked thematically to the toe box cover 400 structural simulation. For instance, the rearfoot portions of shoe 200 have a thematic panel 401 that simulates the appearance of an aspect of the Statue of Liberty, such as the Liberty Torch. Accordingly, the midfoot portion of shoe 200 includes a raised molded stylized feature representing the Liberty Torch.

Toe box cover 30, 300, and 400 may be formed in a wide range of materials and products. In one embodiment, toe box cover 30, 300, and 400 are preferably constructed as a unitary component, non-conductive, and resilient in that they effectively recover to the predefined shape after being pressed inward, downwardly or otherwise deformed. Accordingly, the toe box covers are constructed from a suitable compressible material, such as a polyurethane (PU) foam material 60 or a similar plastic material. The toe box covers are constructed from a mold and using injection molding techniques and other conventional manufacturing techniques.

In one construction, the foam material provides toe box covers 30, 300, and 400 with a molded or sculptured arrangement having significant variations in thickness and contouring to provide a three-dimensional simulation. Referring to FIGS. 5A and 5B, the foam 60 includes an outer surface 62 and an inner surface 64 of the toe box cover. The outer surface 62 may be provide a finished smooth appearance to the toe box cover to create a desired a visual impression for a viewer, such as the wearer or another party. In addition, the foam material 60 can be in any number of color variations throughout for a desired theme or subject area. It is appreciated that thematic panels 31, 301, and 401 can be composed of same materials as the toe box covers.

Figure 4:
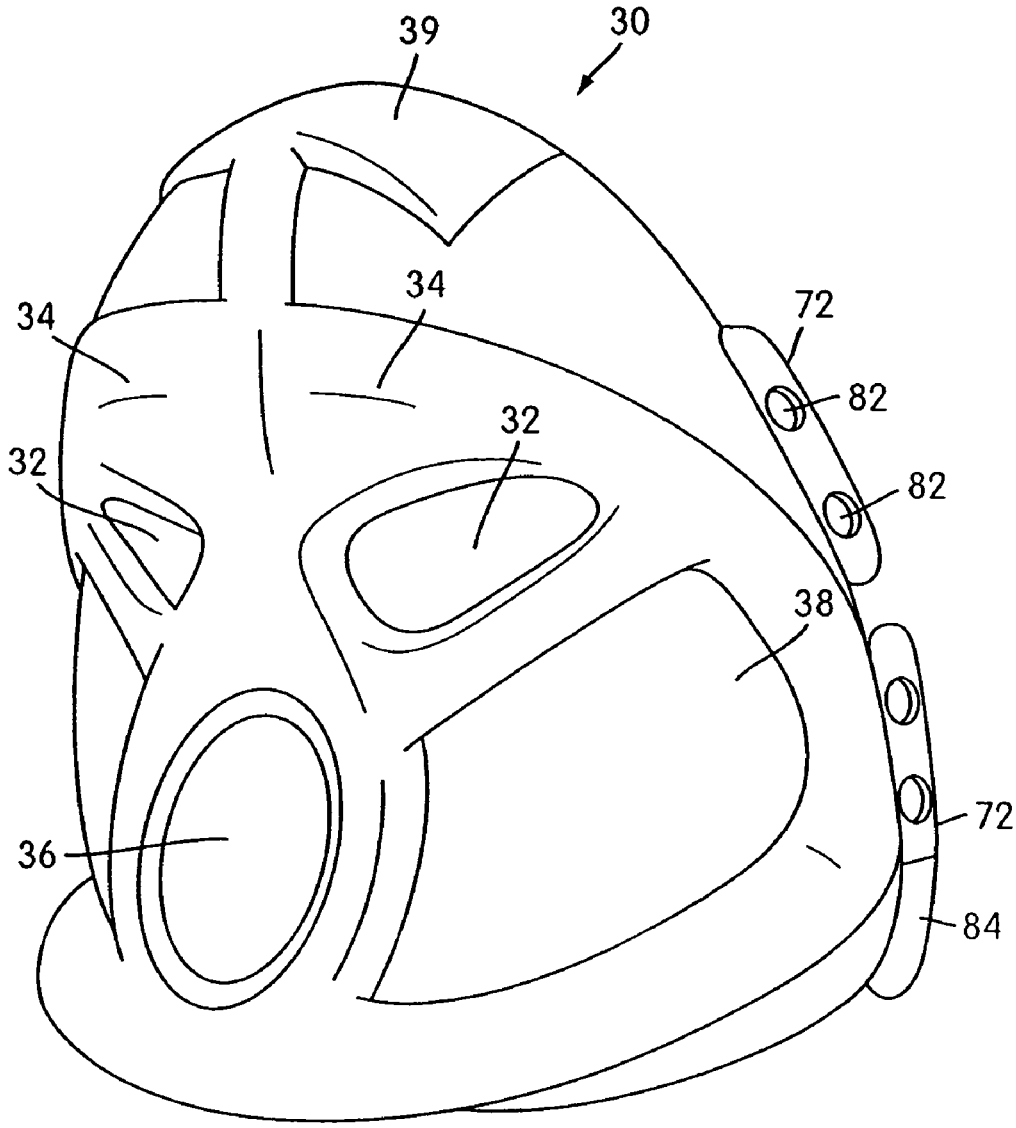
FIG. 4 is a perspective view of the toe box cover of FIGS. 1–3.
Figure 5B:
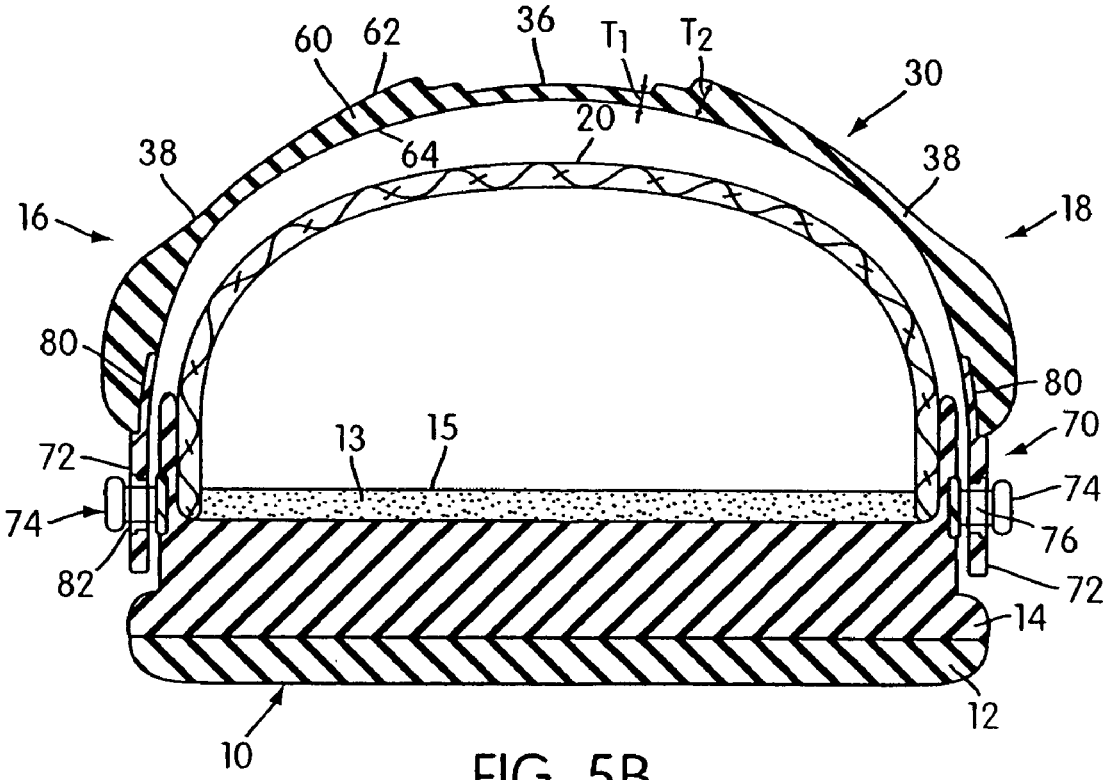
FIG. 5B is cross section of the article of footwear with a themed toe box cover taken along line 5B–35B of FIG. 2.

FIGS. 4, 5A and 5B illustrate the variations in thickness and contouring to provide the distinctive shapes. For instances, toe box cover 30 has nose portions 36 with a generally oval shape (see FIG. 4) and a first thickness T1 in which the interior of the oval shape changes to a second thickness T2 on the perimeter of the oval. Second thickness T2 is greater than first thickness T1 so as to form a structural change in thickness to enhance the stylized appearance of nose portion 36. As shown in FIGS. 5A and 5B, the variations in thickness and contouring may be created between a generally smooth lower surface being concaved, such as inner surface 64, in a step-down/step-up variation with respect to the upper surface, such as outer surface 62. For example, FIG. 5B is cross-section of the article of footwear taken along a media-lateral axis on the forefoot region. When moving on the periphery of the toe cover from the medial side to the lateral side, the outer surface 62 has vertical contouring or vertical thickness changes with respect to the inner surface 64 at specific corresponding transverse peripheral positions of the toe cover. In this manner, the lowermost surface forms a foundation structure with respect to the upper surface for the contouring.

Referring to FIGS. 1–4, contouring is provided throughout the substantial entirety of the toe box cover 30 to form the ornamental features that simulates toy robot 40 shown in FIG. 6. In a further aspect, the eye portions 32 of toe box cover 30 are formed as apertures, which extend through cover 30. In this way, the apertures have a boundary shape which simulates the appearance of eye openings of another article, such as toy robot 40 (See FIG. 6). Nevertheless, the apertures can be used to simulate a wide range of article features, such as a nose or mouth features.

Figure 8:
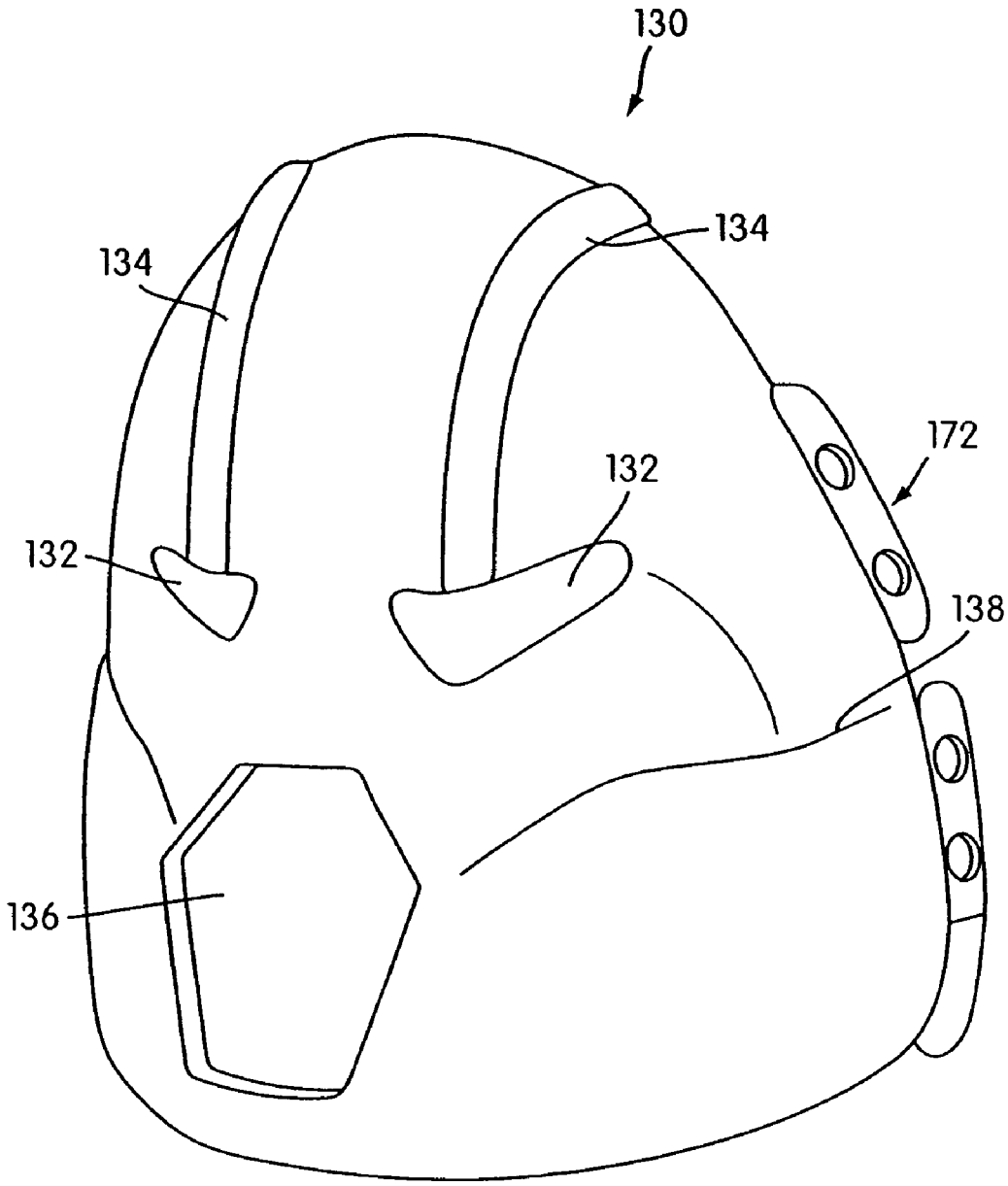
FIG. 8 is a perspective view of an alternative toe box cover.

Referring to FIGS. 3, 4, and 8, in an alternative embodiment, toe box cover 30 and a toe box cover 130 are removable or interchangeable on shoe 2. As shown in FIG. 8, toe box cover 130 includes molded features similarly along a common theme as toe box cover 30, such as eye openings 132, eyebrow portions 134, a nose portion 136, and jaw portions 138 that are representative of the corresponding features of another toy robot (not shown). The toe box cover 30 and toe box cover 130 in an interchangeable configuration provides a number of advantages for a wearer of footwear as well as manufacturers of footwear. For example, a wearer can customize the appearance of the shoe to their tastes or desires.

In one arrangement, shown in FIGS. 3 and 5B, toe box cover 30 is removably coupleable to the shoe 2 by a cover mating or cover fastening system 70. The lower peripheral portion of the toe box cover 30 includes a first mating member 72, such as a lower flange, which interlocks and mates with a corresponding second mating member 74 of shoe 2, such as mating projections. Mating projections 74 are disposed and extend generally perpendicular on sole 10 and serves to attach toe box cover 30 directly to sole 10, preferably at midsole 14. In one arrangement, lower flange 72 is disposed on the medial portion and the lateral portion of the toe box cover 30, while a central portion therebetween is devoid of the flange. In an alternative arrangement, lower flange 72 may be disposed circumferentially around the toe box cover 30. Likewise, mating projections 74 are disposed on the medial portion and lateral portion of midsole 14. Alternatively, the mating projections 74 may extend circumferentially around the forefoot portion of midsole 14 to provide additional support for the toe box cover 30.

Referring to FIG. 5B, it can be seen that mating projections 74 include a body portion 76 having an interlocking enlarged head 78 at the distal end. Mating projections 74 are formed of a durable flexible material, such as a tough rubber material for wear resistance and strength. It should be appreciated that the mating projections may be formed by molding or other manufacturing methods. Lower flange 72 may be constructed of a desirable elastic material, such as an elastomeric material, rubber, or other similar materials. The lower flange 72 can be provided as a narrow band of material that is fixedly attached to toe box cover 30 in a conventional manner, such as by sewing, adhesive or chemical bonding. In one arrangement, the top portion 80 of the lower flange 72 is mounted on the interior surface (inner layer 64) of the toe box cover 30 which protects it against environmental degradation and a provides a trimmed appearance. Alternatively, the top portion 80 of the lower flange 72 may be attached to the outer surface (outer layer 62) of the toe box cover 30.

To perform the interlocking performance of toe box cover 30 and shoe 2, lower flange 72 includes a plurality of apertures 82 so that mating projections 74 extends therein to interlock together. The apertures 82 may be formed in a variety of shapes and sizes, such as a circular, square, or rectangular. Similarly, the mating projections 74 can be virtually any shape and size adapted to be removably coupleable with lower flange 72. As shown in FIGS. 1–3, and 5B, the apertures 82 are circular shaped having a first diameter. The body portions 76 of mating projections have a second diameter which is generally smaller than the first diameter, but adapted to allow body portion 76 to reliably fit and engage the interior surfaces of the aperture 82.

To provide a reliable interlocking function, enlarged heads 78 of the mating projections 74 have a third diameter greater than the first diameter of the apertures 82 and the second diameter of the body 76. Because the lower flange 72 may be constructed of an elastic material, the apertures are expandable to allow the larger diameter interlocking enlarged heads 78 to pass and extend through. In this arrangement, the enlarged head prevents toe box cover 30 from substantial side-to-side movement and decoupling, when the shoe 2 is in motion. Alternatively, the lower flange 72 may be sized to provide an inward compression bias around the sole 10. The compression bias can be generated by providing the lower flange 72 with a circumferential distance that is less than the circumferential distance of the forefoot portion. Hence, the flexible lower flange 72 can be press-fitted in conjunction with the mating projections 74.

In the illustrated embodiments, the lower flange includes medial and lateral (not shown) grip portions 84 disposed at the rear end. Grip portions 84 are sized and adapted to provide a wearer the ability of grasp the flange between their fingers. When the toe box cover 30 is disposed on the shoe 2, a wearer can grasp the grip portions 84 and pull the lower flange laterally away from the mating projections 74 to remove the toe box cover 30 from the respective side. It is appreciated that toe box cover 130 with lower flange 172 has the same function and structure as lower flange 72 of shoe 2.

Figure 7:
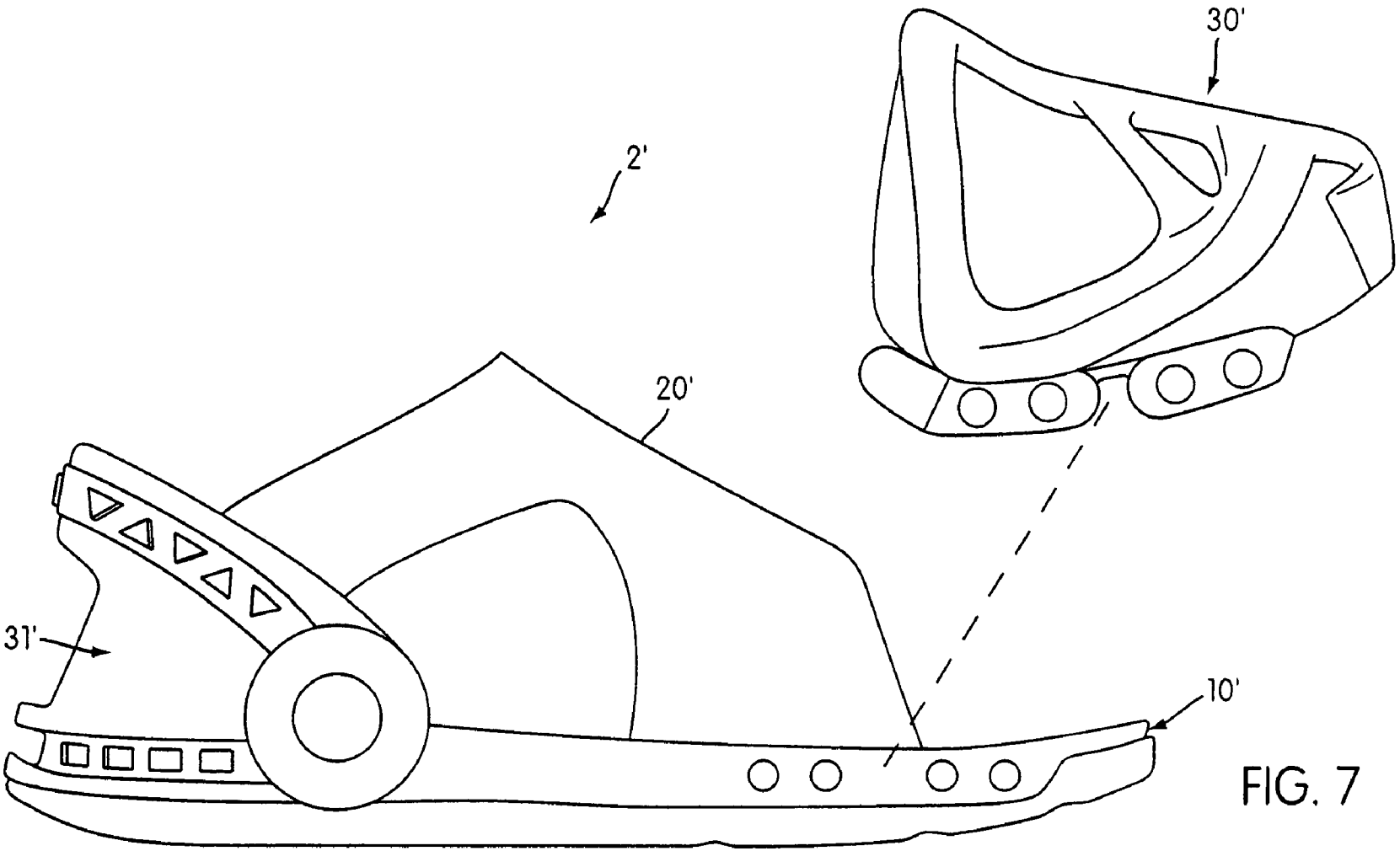
FIG. 7 is an elevational exploded assembly view of a second embodiment of an article of footwear with the themed toe box cover of FIG. 4.

FIG. 7 illustrates an alternative embodiment of an article of footwear designated formed as a sandal 2'. Sandal 2' includes a generally unitary upper 10' configured to place gentle compression forces around the periphery of the foot of a wearer for securely holding the foot in the sandal 2'. Alternatively, the upper 20' may have several bands of material extending from the medial side and the lateral side of the sole 10' as in conventional sandals. In one arrangement, the upper 20' is formed with an elastic woven material and/or padded non-elastic material that extends around the foot or the wearer. In one construction, upper 20' includes woven synthetic elastic fibers made from polyurethane, e.g., spandex. Nevertheless, upper 20' can have other types of materials to achieve foot holding desired characteristics. Upper 20' is fixedly attached to the sole 10' in a conventional manner, such as stitching, gluing, or other known fastening techniques.

In this alternative embodiment, sandal 2' includes a thematic toe box cover 30' configured to cover at least a forefoot portion of the foot of the wearer similarly as shoe 2. Toe box cover 30' has a similar construction and function as toe box cover 30. Further, the previously described toe box covers 300 and 400 can be used with sandal 2' as well. Sandal 2' is configured so that the toe box cover 30' and other toe box covers are removably coupleable thereto. Accordingly, sandal 2' has the same mating system as shoe 2.

The ankle element of sandal 2' includes a second ornamental footwear element formed as a thematic panel 31' which has sculptured or molded features that are thematically associated with the ornamental simulation of toe box cover 30'. Thematic panel 31' can be several shapes, and is preferably a molded band of flexible material. As shown in FIG. 7, the thematic panel 31' includes a mechanized appearance portion simulating a limb of toy robot 40 (see FIG. 6). Nevertheless, other features can be provided on the ankle element.

Figure 11:
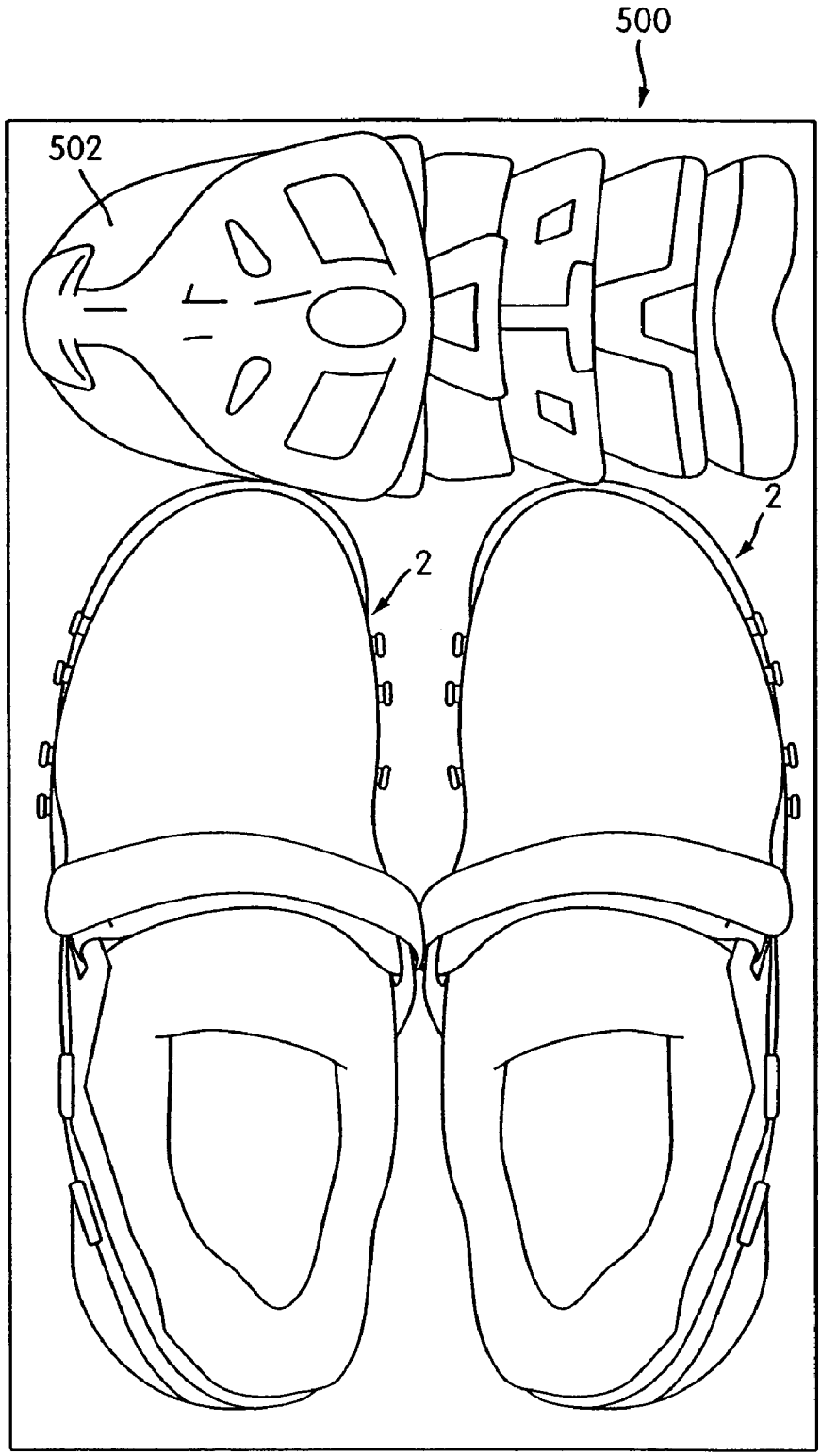
FIG. 11 is a plan view of a kit including an article of footwear and an assortment of toe box covers according to a teaching of the present invention.

In another arrangement, as shown in FIG. 11, a plurality of toe box covers 502 and an article of footwear, such as shoe 2 or sandal 2'(not shown), can be sold or otherwise provided together as a toe box cover system 500 along a predetermined theme. Accordingly, the article of footwear and toe box covers are provided in an enclosure, such as box. In one aspect, each toe box cover is configured to be removably attached to the shoe 2 and sandal 2'. In this way, a consumer is provided with a kit having a toe cover system that can be used for a variety thematic functions and occasions. For instances, the removable toe box covers can be used as fashion accessories for footwear. Instead of a consumer purchasing a different shoe of each different occasion where a certain type of fashionable theme is desired, a single shoe can be reused again by replacing the toe box covers for the theme. Further, a consumer may coordinate the shoe 2 with a specific toe box cover with any appropriate outfit. Advantageously, the consumer can selectively change the appearance of the shoe several times within a day, and no one would know that they had worn the same shoe the day or evening. Hence, the replaceable toe box covers provides efficiency to the consumer and reduces footwear costs.

In a further advantage, marketing and promotional activities can be greatly enhanced with a toe box cover system. A system or a single shoe with a toe box cover can be provided to or purchased by sports fans so that they can wear three-dimensional simulated equipment or portions of simulated equipment of their favorite team. The simulated equipment could be, for example balls, bats, clothing, gloves, hats, helmets or other equipment.

A system in accordance with the teachings of the present invention can greatly assist in marketing of a sports team. In professional leagues and team sports, many of the teams have indicia, which represents a team thematic environment. For example, National Football League™ teams have mascots to include but not limited to an Eagle, a Raven, a Cowboy, a Bronco, a Seahawk, and a Viking. In one configuration, toe box covers could be formed in stylized shapes of team mascots or portions of a team mascot, e.g., an Eagle, a Raven, a Cowboy, a Bronco, a Seahawk, or a Viking. In another example, the players of a team have various physical features and other notable characteristics that could be simulated with a toe box cover to create a three-dimensional caricature.

In one construction, the toe box cover could simulate a characterized portion of the player, such as their head or facial features. In this manner, fans of the sports teams and players may wear toe covers having simulated features of their favorite players to greatly enhance the sporting fan's excitement at a game or other location or display the fan's team spirit. In another construction of a toe box cover, several toe box covers can be molded in the shape and colors of the cap or helmets of various sports teams. It is contemplated that article of footwear and toe box covers of the present invention can be applied to collegiate sports, teams and leagues. It is also contemplated that the footwear and toe covers may simulate aspects of other organized sports to include but not limited to hockey, bicycling, skiing, skating, running, soccer, rugby, baseball, basketball and/or Olympic sports. In this manner, the sports team or league, advertiser, college sports program and the like are able to have enhanced promotion to increase sales and team awareness/spirit.

In a further aspect of the present invention, toe box covers 30, 300, and 400 can be advantageously employed as a sales promotion aid or tool. A process is provided for selling an article of footwear associated with a theme. A primary footwear element is exposed for sale at a physical location and an online location, such as a website on the Internet. Next, at least two distinct toe box covers are exposed for sale, in which each toe box cover is configured to be removably coupleable to the primary footwear element. Further, each toe box cover is an ornamental sculptural work that simulates the appearance of another and different article, e.g. not simulating the toe box cover. Next, the user is permitted to choose at least one of the toe box covers previously exposed. As a result, the primary footwear element and the selected toe box cover are provided to the purchaser.

EXAMPLE MASS MEDIA PRESENTATION ENVIRONMENTS

In one embodiment of the present invention, footwear can be configured to represent the environment of mass media presentations, such as television shows/programs, dramatic mini-series, comic books, motion pictures, and/or video games media. For example, the toe box cover can have a design that simulates the appearance of a popular television animated character or a super hero character or villain, and if desired, the midfoot and rearfoot for portions can include visual appearance and structural features that are linked thematically to the character of the toe box cover structural simulation.

In one example, the fictional superhero series BATMAN™ from comic books, a television show, and movies, includes a number of characters including noted heroes (e.g., Batman and Robin), the villains (e.g., the Joker, Riddler, the Penguin, and Catwoman), and supporting characters (such as Alfred and Commissioner Gordon). Further, objects specifically associated with the Batman environment include his Batmobile and his utility belt. In an exemplary embodiment, the toe box cover can be a sculptural representation of any of the characters. Thus, for example, the stylized sculptural representation of the character could be formed by contours and/or variations in thickness of the toe cover member, and holes could be provided in the cover member to simulate body parts such as eyes or a mouth. Various different toe box covers would be marketed to enable a purchaser the ability to select his or her favorite toe box cover simulation(s). Further, if desired, a corresponding portion of the shoe such as the rear quarter panels can simulate any aspect of the Batman environment, such as the Batmobile or utility belt.

In another example, the SIMPSONS™ animated television show includes a number of primary characters (including Homer, Marge, Bart, Lisa, and Maggie Simpson), and supporting characters (such as Mr. Burns, Barney, Ned Flanders, Groundskeeper Willie, Apu, Chief Wiggum, Krusty the Clown). In another exemplary embodiment of the invention, the toe box cover can be a sculptural representation of any of the characters of the show. Thus, for example, the stylized sculptural representation of the character could be formed by contours and/or variations in thickness of the toe cover member, and holes could be provided in the cover member to simulate body parts such as eyes or a mouth. Various different toe box covers would be marketed to enable a purchaser the ability to select his or her favorite or favorite toe box cover simulation(s). Further, if desired, a corresponding portion of the shoe such as the rear quarter panels can simulate an aspect of the Springfield (the town where the Simpsons live) environment such as the Quick-E-Mart, the statute of the town's founder Jebidiah Springfield, or the town's Nuclear Power Plant.

In yet another example, the characters may be from the animated NICKELODEON™ television show SPONGEBOB SQUAREPANTS™, including for example Spongebob Squarepants, Squidward Tentacles, Patrick Starfish, Sandy Cheeks, Mr. Krabs, or Gary. In another exemplary embodiment of the invention, a toe box cover can be a sculptural representation of any of the characters of the show. Thus, for example, the stylized sculptural representation of the character could be formed by contours and/or variations in thickness of the toe cover member, and holes could be provided in the cover member to simulate body parts such as eyes or a mouth. Various different toe box covers would be marketed to enable a purchaser the ability to select his or her favorite or favorite toe box cover simulation(s). Further, if desired, a corresponding portion of the shoe such as the rear quarter panels can simulate any aspect of the show including the Krusty Krab Resturant, a Krabbie Patty, or another aspect from the undersea town of Bikini Bottom where the character Spongebob Squarepants lives.

Aspects of the present invention can provide a child with the ability to use his or her imagination, alone or with friends, in a positive manner. Children can use the interchangeable toe box covers for role playing or for playing games. For example, the appearance of the toe box covers can have various themes or simulations of popular toys and products that are associated with children, such as television shows with action figures or other characters. Also, based on the simulated appearance, the toe box covers can be traded or swapped and collected by children similarly as trading cards. For example, a child may trade a thematical toe cover within the same theme series, e.g., a Batman simulated toe cover for a Riddler simulated toe cover within the BATMAN™ series. Alternatively, a child may swap toe covers between different theme series, e.g., a SIMPSONS™ based toe cover for a BATMAN™ or SPONGEBOB SQUAREPANTS™ based toe cover. Further, in a sports thematic toe cover embodiment, the swapping toe covers could based on different sports, e.g., between football and baseball; based on intra-team thematic covers, e.g., toe cover simulating player features; or based on inter-team thematic covers.

Aspects footwear of the present invention can provide a manufacture or retailer with a method to improve inventory control and/or reduce operating costs. For example, retailers can stock footwear with common theme toe box covers that are the most popular sellers. In one instance, a retailer or other provider can stock many different style toe covers for just one type of base shoe, instead of stocking numerous shoes with different themes. A consumer purchase decision may be based on the thematic appearance of the shoe or toe box cover appearance. It is possible that there will be a variation in the quantity of the units sold between the shoes with different themes, which may lead to overstocks for some of the shoes. To avoid this overstock problem, the retailer can save the cost of shoe verses the toe cover.

Thus, an article of footwear having a thematical toe cover arrangement has been described. The article of footwear includes a toe box cover that may be removably coupleable to a primary shoe element in which the toe box cover has an ornamental sculptured work simulating the appearance of another and different article. In one arrangement, a thematic toe box cover may be used as a stylized fashion accessory for footwear. In another arrangement, a thematic toe box cover may be used to as part of a marketing mix—that is a mixture of marketing techniques. For example, pricing, packaging, and advertising, used to promote the sale of another product (article of manufacture) with a variety of themed footwear products. In yet another arrangement, a thematic toe box cover may be used as a promotional and marketing implement relating to a predefined theme or subject area. In accordance with the present invention, the predefined themes or subject areas may include, but are not limited to, motion picture promotions, fictional characters, professional and amateur sports, video and computer gaming, entertainment, music, theme parks, business, print and electronic media, or politics and the like. Several arrangement of an article of footwear of the present invention provides a unique marketing technology for supporting other products.

While the present invention has been described with reference to preferred and exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention include all embodiments falling within the scope of the appended claims.

What is claimed is:

1. An article of footwear, comprising:

a sole;

an upper having at least a forefoot portion and a rearwardly disposed side panel; and a forefoot cover provided to substantially envelop the forefoot portion of the upper and the forefoot cover being removably coupleable to the sole, the forefoot cover having a first ornamental contoured member and the side panel having a second ornamental contoured member, wherein the first ornamental contoured member and the second ornamental contoured member collectively define an ornamental sculptural work simulating another article different from the article of footwear.

2. The article of footwear in accordance with claim 1, wherein the ornamental sculptural work simulates a facial feature of the another article.

3. The article of footwear in accordance with claim 1, wherein the ornamental sculptural work comprises a robot.

4. The article of footwear in accordance with claim 1, wherein the ornamental sculptural work comprises an outer body of an automobile.

5. The article of footwear in accordance with claim 1, wherein the ornamental sculptural work is formed at least in part by changes in thickness of the first ornamental contoured member and the second ornamental contoured member.

6. The article of footwear in accordance with claim 1, wherein the ornamental sculptural work is formed at least in part by apertures extending through a thickness in the first ornamental contoured member.

7. The article of footwear in accordance with claim 6, wherein the apertures simulate the eyes of the another article.

8. The article of footwear in accordance with claim 1, wherein the forefoot cover includes at least a resilient outer layer and a layer of compressible foam.

9. The article of footwear in accordance with claim 1, further comprising a mating system including a first mating portion being attached to the forefoot cover and a second mating portion being disposed on the sole, said first mating portion being removably coupled to the second mating portion.

10. The article of footwear in accordance with claim 9, wherein the first mating portion extends downwardly from a lower periphery of the forefoot cover and the first mating portion includes a plurality of apertures configured to receive the second mating portion therein.

11. The article of footwear in accordance with claim 10, wherein the sole further comprising a midsole and the second mating portion extends from the midsole.

12. The article of footwear in accordance with claim 9, wherein the first mating portion comprises a resilient material which provides a resilient bias.

13. The article of footwear in accordance with claim 9, wherein the second mating portion include at least a body portion extending generally normal to the midsole and the body portion having an interlock head at a free end.

14. The article of footwear in accordance with claim 1, wherein the side panel further comprises a molded plastic material.

* * * * *